US006568586B1

(12) United States Patent
VanEsley et al.

(10) Patent No.: US 6,568,586 B1
(45) Date of Patent: May 27, 2003

(54) FOLDABLE CARDBOARD FOOD BOX HAVING FOOD RECEPTACLE AND DIP TRAY

(75) Inventors: Thomas M. VanEsley, Redford, MI (US); Karen M. Chiera, Elmhurst, IL (US)

(73) Assignee: Domino's Pizza PMC, Inc., Ann Arbor, MI (US)

( * ) Notice: Subject to any disclaimer, the term of this patent is extended or adjusted under 35 U.S.C. 154(b) by 0 days.

(21) Appl. No.: 10/214,245

(22) Filed: Aug. 6, 2002

(51) Int. Cl.[7] ..... B65D 5/488

(52) U.S. Cl. ..... 229/120.18; 206/562; 229/110; 229/904; 229/906

(58) Field of Search ..... 229/110, 120.18, 229/902, 904, 906; 206/562, 563, 564, 565

(56) References Cited

U.S. PATENT DOCUMENTS 2,375,843 A * 5/1945 Gottlieb ..... 229/120.18
2,924,372 A * 2/1960 Kirkeby ..... 206/563
3,089,631 A * 5/1963 Tyrseck et al. ..... 229/120.18
3,642,125 A * 2/1972 Johnson ..... 229/120.18
3,899,119 A * 8/1975 Roccaforte ..... 206/562
4,394,905 A * 7/1983 Hackenberg ..... 206/562
4,572,423 A * 2/1986 Spencer ..... 229/904
4,757,937 A * 7/1988 Maio et al. ..... 229/904
4,895,259 A * 1/1990 Paley ..... 206/565
4,919,326 A 4/1990 Deiger
5,110,039 A 5/1992 Philips
5,118,032 A 6/1992 Geho
5,205,474 A * 4/1993 Stuart et al. ..... 229/904
5,211,329 A 5/1993 Patton
5,368,225 A 11/1994 Ritter
5,381,949 A 1/1995 Correll
D356,254 S 3/1995 Correll (List continued on next page.)

*Primary Examiner*—Gary E. Elkins
(74) *Attorney, Agent, or Firm*—Brooks & Kushman P.C.

(57) ABSTRACT

A foldable cardboard food box (10) includes a base (16), a back wall (28), a cover (34), a front wall (46), a dip tray panel (54), a support wall (64), and base side wall assemblies (74) that are constructed such that upon folding the box provides a food receptacle (12) and a dip tray section (14) with a dip tray panel (54) supported by side wall vertical edge junctions (108) that are spaced rearward from the front wall (46).

17 Claims, 6 Drawing Sheets

U.S. PATENT DOCUMENTS

| | | | | | |
|---|---|---|---|---|---|
| 5,452,845 | A | | 9/1995 | Ritter | |
| 5,524,814 | A | | 6/1996 | Davis | |
| D371,296 | S | | 7/1996 | Correll | |
| 5,535,940 | A | | 7/1996 | Olds | |
| 5,549,241 | A | | 8/1996 | Correll | |
| 5,553,771 | A | | 9/1996 | Correll | |
| 5,586,716 | A | | 12/1996 | Correll | |
| 5,595,339 | A | | 1/1997 | Correll | |
| D380,152 | S | | 6/1997 | Correll | |
| D380,965 | S | | 7/1997 | Correll | |
| D385,785 | S | | 11/1997 | Correll | |
| 5,702,054 | A | | 12/1997 | Philips et al. | |
| 5,713,509 | A | | 2/1998 | Correll | |
| 5,752,651 | A | | 5/1998 | Correll | |
| 5,806,755 | A | | 9/1998 | Correll | |
| D400,438 | S | | 11/1998 | Correll | |
| 5,833,130 | A | | 11/1998 | Correll | |
| D402,435 | S | | 12/1998 | Correll | |
| 5,881,948 | A | | 3/1999 | Correll | |
| 5,890,648 | A | * | 4/1999 | Cai | 229/902 |
| 5,918,797 | A | | 7/1999 | Correll | |
| 5,961,035 | A | | 10/1999 | Correll | |
| 6,016,951 | A | | 1/2000 | Correll | |
| 6,065,669 | A | | 5/2000 | Correll | |
| 6,070,791 | A | | 6/2000 | Correll | |
| D427,526 | S | | 7/2000 | Correll | |
| 6,092,715 | A | | 7/2000 | Correll | |
| 6,109,512 | A | | 8/2000 | Morrison | |
| D436,533 | S | | 1/2001 | Correll | |
| 6,196,448 | B1 | | 3/2001 | Correll | |
| 6,206,277 | B1 | | 3/2001 | Correll | |
| 6,213,389 | B1 | * | 4/2001 | Cai | 229/904 |
| 6,223,979 | B1 | | 5/2001 | Correll | |
| 6,290,122 | B1 | | 9/2001 | Correll | |

* cited by examiner

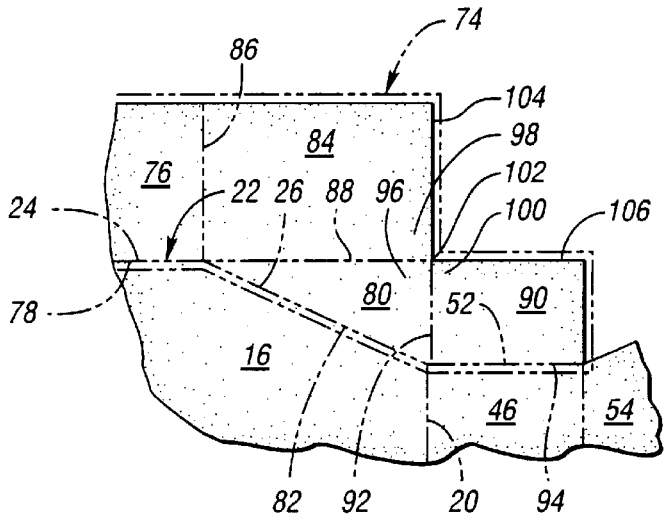
Fig. 2
Fig. 3
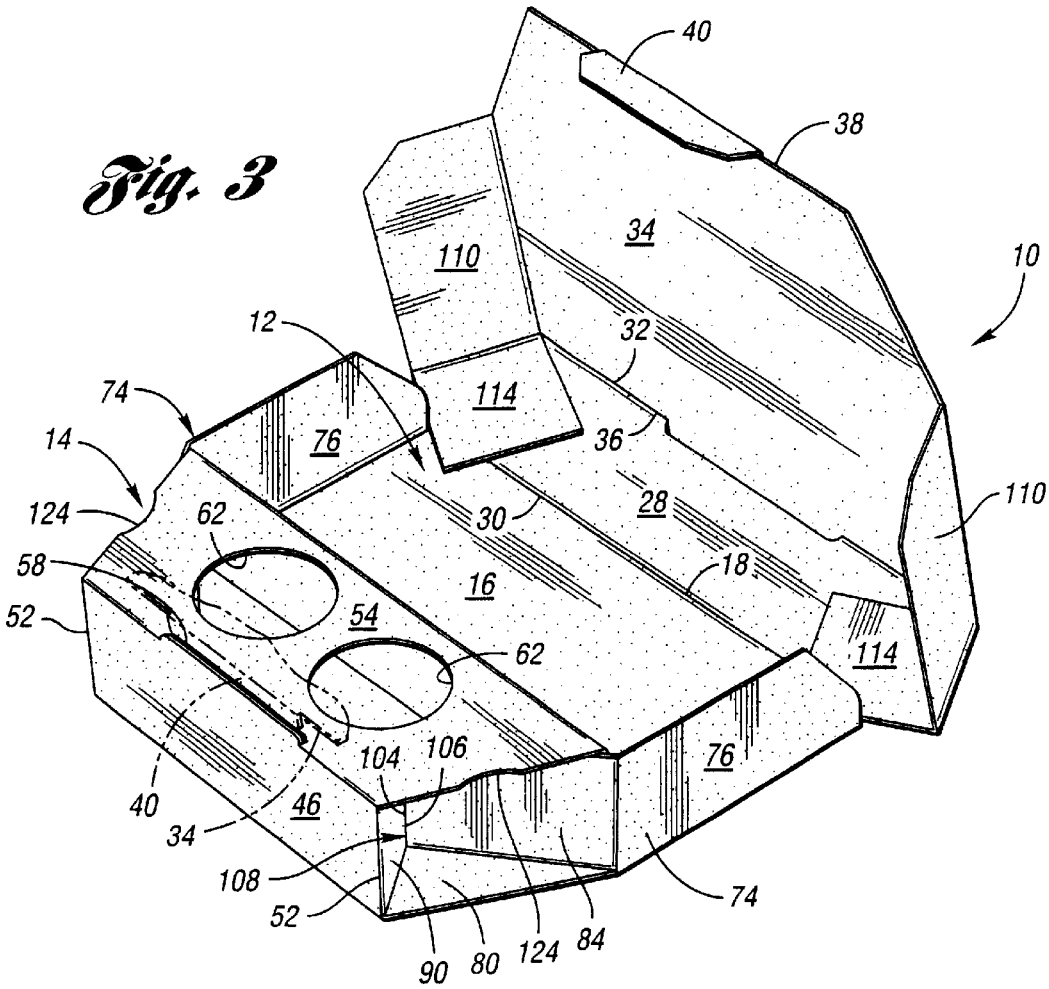

FOLDABLE CARDBOARD FOOD BOX HAVING FOOD RECEPTACLE AND DIP TRAY

BACKGROUND OF THE INVENTION

1. Field of the Invention

This invention relates to a foldable cardboard food box that has a closable food receptacle for receiving food and also has a dip tray for receiving one or more dip sauce cups.

2. Background Art

Foldable cardboard food boxes are made of corrugated cardboard including a pair of cardboard sheets spaced by an intermediate corrugated cardboard spacers and searched thereto by an adhesive. Such cardboard food boxes have previously included a closable food receptacle for receiving food such as heated chicken pieces, bread sticks, etc. as well as including a dip tray for receiving at least one dip sauce cup that facilitates dipping and eating of the food such as at a spectator event whose seating requires that the food be held in the person's lap during the eating.

Prior foldable cardboard food boxes, most of which have only a food receptacle unlike the food box of the present invention which also has a dip tray, are disclosed by U.S. Pat No. Des. 356,254 Correll; U.S. Pat. No. Des. 371,296 Correll; U.S. Pat. No. Des. 380,152 Correll; U.S. Pat. No. Des. 380,965 Correll; U.S. Pat. No. Des. 385,785 Correll; U.S. Pat. No. Des. 394,388 Correll; U.S. Pat. No. Des. 400,438 Correll; U.S. Pat. No. Des. 402,435 Correll; Des. 427,526 Correll; U.S. Pat. No. 436,533 Correll; U.S. Pat. No. 4,919,326 Deiger; U.S. Pat. No. 5,110,039 Philips; U.S. Pat. No. 5,118,032 Geho; U.S. Pat. No. 5,211,329 Patton; U.S. Pat. No. 5,368,225 Ritter; U.S. Pat. No. 5,381,949 Correll; U.S. Pat. No. 5,452,845 Ritter; U.S. Pat. No. 5,524,814 Davis; U.S. Pat. No. 5,535,940 Olds; U.S. Pat. No. 5,549,241 Correll; U.S. Pat. No. 5,553,771 Correll; U.S. Pat. No. 5,586,716 Correll; U.S. Pat. No. 5,595,339 Correll; U.S. Pat. No. 5,702,054 Philips et al.; U.S. Pat. No. 5,713,509 Correll; U.S. Pat. No. 5,752,651 Correll; U.S. Pat. No. 5,806,755 Correll; U.S. Pat. No. 5,833,130 Correll; 5,881,948 Correll; U.S. Pat. No. 5,918,797 Correll; U.S. Pat. No. 5,961,035 Correll; U.S. Pat. No. 6,016,951 Correll; 6,065,669 Correll; U.S. Pat. No. 6,070,791 Correll; U.S. Pat. No. 6,092,715 Correll; U.S. Pat. No. 6,109,512 Morrison; 6,196,448 Correll; U.S. Pat. No. 6,026,277 Correll; U.S. Pat. No. 6,223,979 Correll; and U.S. Pat. No. 6,290,122 Correll.

SUMMARY OF THE INVENTION

An object of the present invention is to provide an improved foldable cardboard food box having a food receptacle that can be opened and closed and a dip tray for supporting one or more dip sauce cups so as to facilitate eating of food while standing or sitting, such as at a spectator event where there is no table or other convenient way of consuming the food.

In carrying out the above object, the foldable cardboard food box of the invention includes a base having a D shape including a straight back edge, a straight front edge of a smaller length than the back edge, a pair of side edges having a pair of rearward portions that extend from the back edge parallel to each other toward the front edge, and the pair of side edges also have a pair of forward portions that respectively extend from the pair of rearward portions toward the front edge in a converging manner. A back wall of the food box has a first edge connected to the back edge of the base and has a second edge extending in a spaced and parallel relationship to its first edge. A cover of the food box has a first edge connected to the second edge of the back wall and has a second edge extending in a spaced and parallel relationship to its first edge and including a tuck flap, and the cover also has an elongated shape including opposite ends. A front wall of the food box has a first edge connected to the front edge of the base and has a second edge extending in a spaced and parallel relationship to its first edge, and the front wall has an elongated shape including opposite ends. A dip tray panel of the food box has a front edge connected to the second edge of the front wall and has a rear edge extending in a spaced and parallel relationship to its front edge but with a greater length, and the dip tray panel also has at least one opening for receiving a dip sauce cup. A support wall of the food box has a first edge connected to the rear edge of the dip tray panel and has a second edge including a tuck flap. A pair of base side wall assemblies of the food box are respectively connected to the pair of side edges of the base. Each base side wall assembly includes a rearward side wall connected to the rearward portion of one of the base side edges, a triangular connection panel connected to the forward portion of the associated base side edge, a first rectangular forward side wall connected to the rearward side wall and to the triangular connection panel, and a second rectangular forward side wall connected to the triangular connection panel and the adjacent end of the front wall. The triangular connection panel and the first and second rectangular forward side walls of each base side wall assembly each have right angle corners having a common junction with each other. The back wall, the front wall, the dip tray panel, the support wall, and the pair of base side wall assemblies are foldable to provide a food receptacle and to support the dip tray above the base with the first and second forward side walls of each base side wall assembly having engaged vertical edges providing a vertical junction with each other spaced rearwardly from the front wall to provide support of the dip tray panel. The cover is foldable to close the food receptacle and to selectively provide opening thereof for consumption of food within the receptacle.

The food box also includes a pair of cover side walls respectively connected to opposite ends of the cover. A pair of cover back wall closure flaps are respectively connected to the pair of cover side walls. In one construction, the pair of cover side wall flaps are square. In another construction, the pair of cover side wall flaps are generally square and have projections that extend toward each other adjacent the rear edge of the base after folding of the food box.

The food box has the dip tray panel disclosed as including a pair of openings for respectively receiving a pair of dip sauce cups. In one construction, each of the pair of openings in the dip tray panel is round, while another construction has one of the pair of round openings in the dip tray panel including a pair of diametrically opposite sizing tabs, and a further construction has each of the pair of round openings in the dip tray panel including a pair of diametrically opposite sizing tabs.

One construction of the food box has the cover including a rearward portion that covers the food receptacle and a forward portion that covers the dip tray panel. The front wall and dip tray panel have a connection including a slit that receives the cover flap to secure the cover in a closed position with this construction. The dip tray panel of this construction also is disclosed as including at least one notch that facilitates manual access to the forward portion of the cover for opening of the cover, and may also include a pair of notches that facilitate the manual access to the forward portion of the cover for opening of the cover. One construction has the forward portion of the cover imperforate, while another construction has the forward portion of the cover including openings through which dip sauce cups can be viewed.

A further construction has the cover extending only over the food receptacle. In this construction, the dip tray panel and the support wall have a connection including a slit that receives the cover flap to secure the cover in a closed position.

The objects, features and advantages of the present invention are readily apparent from the following detailed description of the preferred embodiments when taken in connection with the accompanying drawings.

BRIEF DESCRIPTION OF THE DRAWINGS

FIG. 2 is a partial enlarged portion of FIG. 1 illustrating the construction of base side wall assemblies of the food box.

FIG. 3 is a perspective view illustrating the construction of the folded food box with its cover shown in a solid line indicated opened position and a partial phantom indicated closed position.

DETAILED DESCRIPTION OF THE PREFERRED EMBODIMENTS

Figure 1:
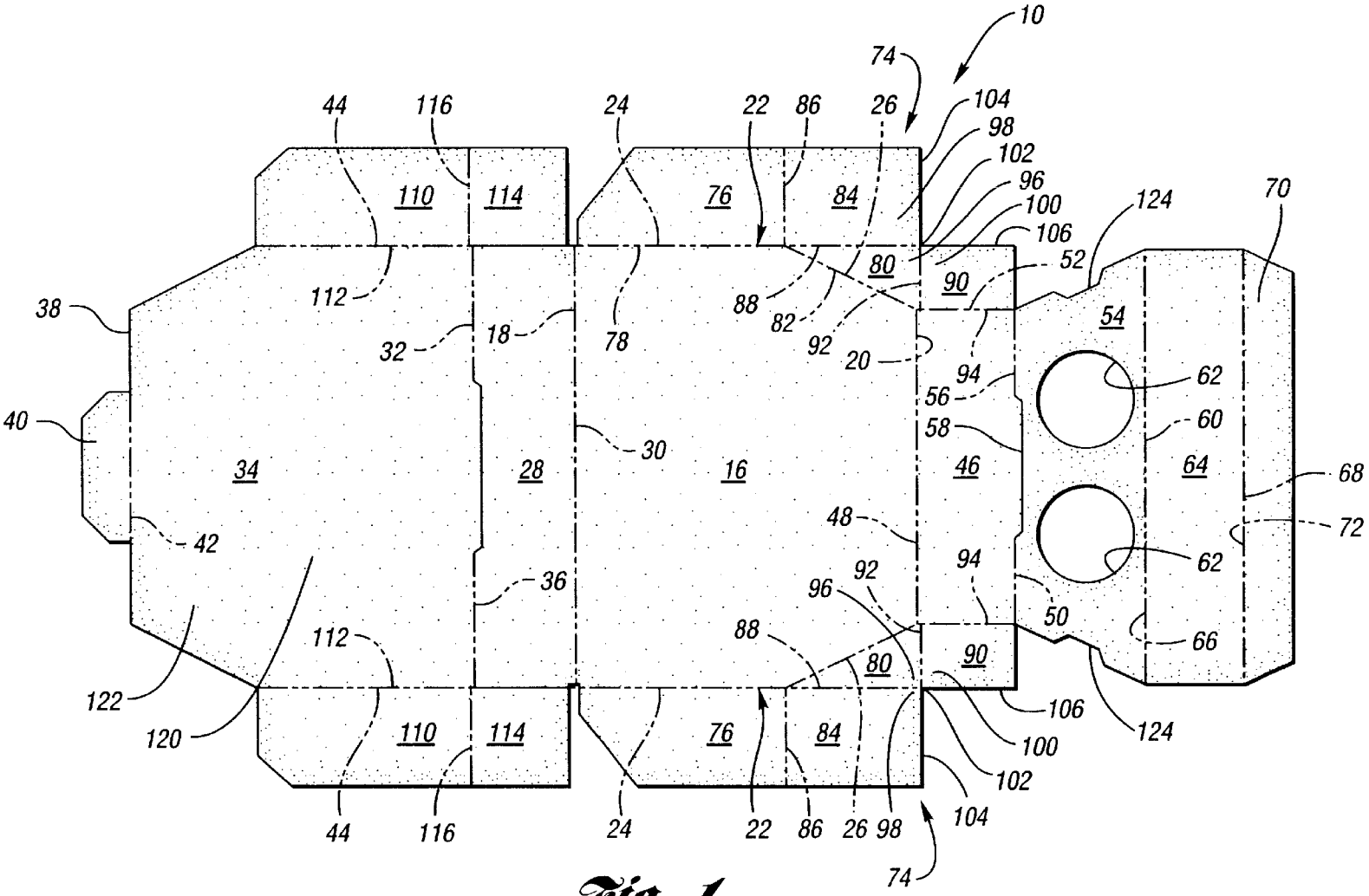
FIG. 1 is a plan view of a foldable cardboard food box that is constructed in accordance with the present invention.

With reference to FIG. 1 of the drawings, one embodiment of a foldable cardboard food box constructed in accordance with the invention from corrugated cardboard is indicated generally by 10 and is illustrated in a flat unfolded condition prior to folding thereof as shown in FIG. 3 to provide a rear food receptacle 12 and a front dip tray section 14. Food such as heated chicken pieces, bread sticks, etc. received within the food receptacle 12 may be covered and opened as is hereinafter described and may be dipped in the sauce in the cup so as to facilitate eating while standing or sitting in situations which are not particularly conducive to eating, such as at spectator events where there is no conveniently located table.

With reference to FIG. 1, the food box 10 of the invention includes a base 16 having a D shape including a straight back edge 18, a straight front edge 20, and a pair of side edges each of which is collectively indicated by 22. The pair of base side edges 22 have a pair of rearward portions 24 that extend from the back edge 18 parallel to each other toward the front edge 20, and the pair of side edges 22 also have a pair of forward portions 26 that respectively extend from the pair of rearward portions 24 toward the front edge 20 in a converging manner so that the base edges collectively provide its D shape.

The food box 10 illustrated in FIG. 1 also has a back wall 28 having a first edge 30 connected by a scored fold line to the back edge 18 of the base 16. The back wall 28 also has a second edge 32 extending in a spaced and parallel relationship to its first edge 30.

With continuing reference to FIG. 1, the food box 10 has a cover 34 including a first edge 36 connected by a scored fold line to the second edge 32 of the back wall 28. A second edge 38 of the cover extends parallel to its first edge 36 and includes a tuck flap 40 connected thereto by a scored fold line 42. The cover 34 has an elongated shape including opposite ends 44.

A front wall 46 of the food box 10 shown in FIG. 1 has a first edge 48 connected to the front edge 20 of the base 16 by a scored fold line and also has a second edge 50 extending in a spaced and parallel relationship to its first edge. The front wall has an elongated shape including opposite edge 52.

A dip tray panel 54 of the food box 10 shown in FIG. 1 has a front edge 56 connected by a scored fold line with a central tuck flap slit 58 to the second edge 50 of the front wall 46. A rear edge 60 of the dip tray panel 54 extends in a spaced and parallel relationship to its front edge 56 but with a greater length. The dip tray panel 54 has at least one opening 62 for receiving a dip sauce cup and, as illustrated, has two of such openings which are of a round shape. It should also be appreciated that the dip tray panel can include three or more openings although in most instances two is sufficient.

A support wall 64 of the food box 10 is illustrated in FIG. 1 as having a first edge 66 connected by a scored fold line to the rear edge 60 of the dip tray panel 54 and as having a second edge 68 including a tuck flap 70 connected thereto by a scored fold line 72.

As collectively illustrated by FIGS. 1 and 2, the food box 10 includes a pair of base side wall assemblies 74 respectively connected to the pair of side edges 22 of the base 16. More specifically, each base side wall assembly includes a rearward side wall 76 connected by a scored fold line 78 to the rearward portion 24 of one of the base side edges 22. A triangular connection panel 80 of each base side wall assembly 74 is connected by a scored fold line 82 to the forward portion 26 of the associated base side edge 22. A first rectangular forward side wall 84 is respectively connected by scored fold lines 86 and 88 to the rearward side wall 76 and to the triangular connection panel 80, while a second rectangular forward side wall 90 is respectively connected by scored fold lines 92 and 94 to the triangular connection panel 80 and the adjacent end 52 of the front wall 46.

As best illustrated in FIG. 2, the triangular connection panel 80 and the first and second rectangular forward side walls 84 and 90 of each base side wall assembly 74 each have respective right angle corners 96, 98 and 100 having a common junction 102 with each other. Upon folding of the food box 10 to its constructed condition shown in FIG. 3, the back wall 28, the front wall 46, the dip tray panel 54, the support wall 64, and the pair of base side wall assemblies are folded to provide the food receptacle 12 and to support the dip tray 54 above the base 16. Furthermore, the first and second forward side walls 84 and 90 of each base side wall assembly 74 have respective engaged vertical edges 104 and 106 that cooperatively provide a vertical junction 108 with each other spaced rearwardly from the front wall 46 to provide support of the dip tray panel 54 above the base 16. The cover 34 is movable from the opened position shown by solid line representation to a closed position shown partially by phantom line representation where the cover tuck flap 40 is received by the slit 58 with the cover enclosing the food receptacle 12.

The constructed terms front and back, forward and rearward are used with respect to the upright folded food receptacle as shown in FIG. 3 where the front and forward extremity is at the dip tray area and the back or rear extremity is at the connection of the cover to the back wall.

It should be mentioned that the food box has the support wall tuck flap 70 tucked between the triangular connection panels 80 and the base 16 to maintain the folded condition for use.

Figure 7:
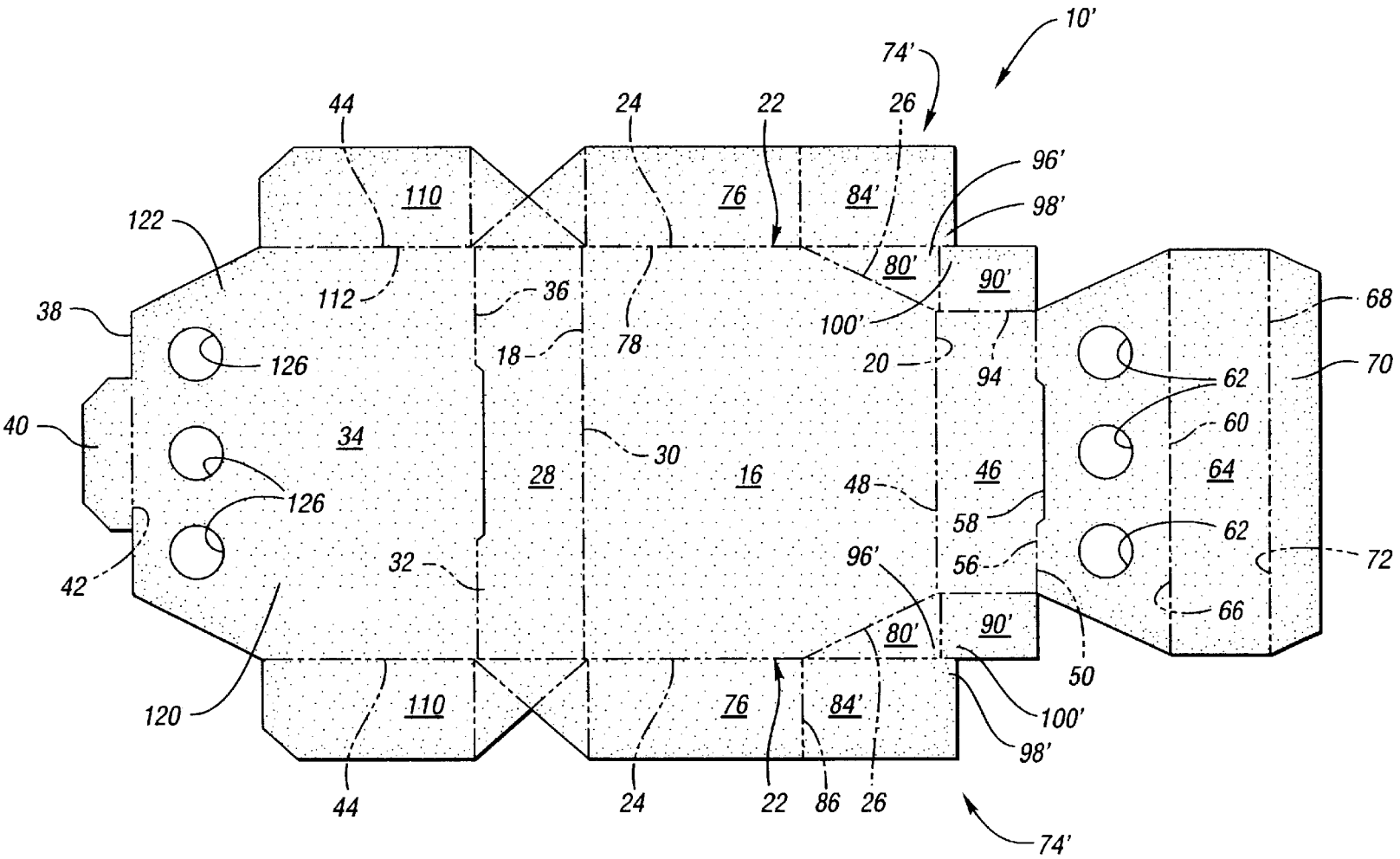
Fig. 7 (PRIOR ART)
FIG. 7 is a view of a prior art foldable cardboard food box.

In the prior art as illustrated by FIG. 7, a foldable corrugated cardboard food box with a somewhat different construction has like components identified by like reference numerals as the embodiment described above in connection with FIGS. 1–3. However, in this prior art food box 10', the base side wall assemblies 74' do not have their triangular connection panel 80' and their first and second rectangular forward side walls 84' and 90' provided with right angle corners 96', 98' and 100' constructed to have a common junction with each other. As such, the prior art food box does not have the provision of a food receptacle and a dip tray section upon folding with the dip tray panel supported above the base as described above by engaged vertical edges that provide a vertical junction spaced rearwardly from the front wall. Rather, in the prior art, the first forward side wall 84 extends all the way to the front wall and, while these walls provide vertical support, the support is not provided by vertically engaged edges in accordance with the present invention at a location rearward from the front wall. Also, the prior art construction positions the forward side wall 84' such that it can interfere with the dip sauce cup openings 62 at locations that are not obstructed by the construction of the present invention.

In addition to the embodiment of FIGS. 1–3 which is further described below, FIGS. 4, 5 and 6 also illustrate further embodiments of corrugated cardboard food boxes constructed in accordance with the invention and respectively identified by reference numerals 10*a*, 10*b* and 10*c*. These additional embodiments are also further described below but have like reference numerals identifying like components thereof such that the description in connection with FIGS. 1–3 is also applicable in many aspects and thus need not be repeated.

As illustrated in FIGS. 1 and 3, the food box 10 includes a pair of cover side walls 110 that are respectively connected to the cover ends 44 by associated scored fold lines 112. These cover side walls 110 as shown in FIG. 3 are positioned on the outside of the rearward base side wall 76 of the adjacent base side wall assembly 74. Furthermore, a pair of cover back wall closure flaps 114 are respectively connected to the pair of cover side walls 110 by associated scored fold lines 116 and are captured between the base 16 and the cover 34 upon cover closing so as to hold the cover side walls 110 adjacent the rearward side walls 76 in the closed position. As illustrated in FIG. 1, the cover back wall closure flaps 114 are square. In the embodiment of the food box 10*b* shown in FIG. 5, the cover back wall closure flaps 114 are generally square but have projections 116 that extend toward each other after folding of the food box. These projections 116 tend to pull the cover side wall flaps 110 inwardly upon the initial cover closing to thereby enhance the proper side wall positioning at an earlier stage of the cover closing and to further insure the proper positioning after folding by the greater length of engagement of these flaps with the base 16 after the closing.

Figure 4:
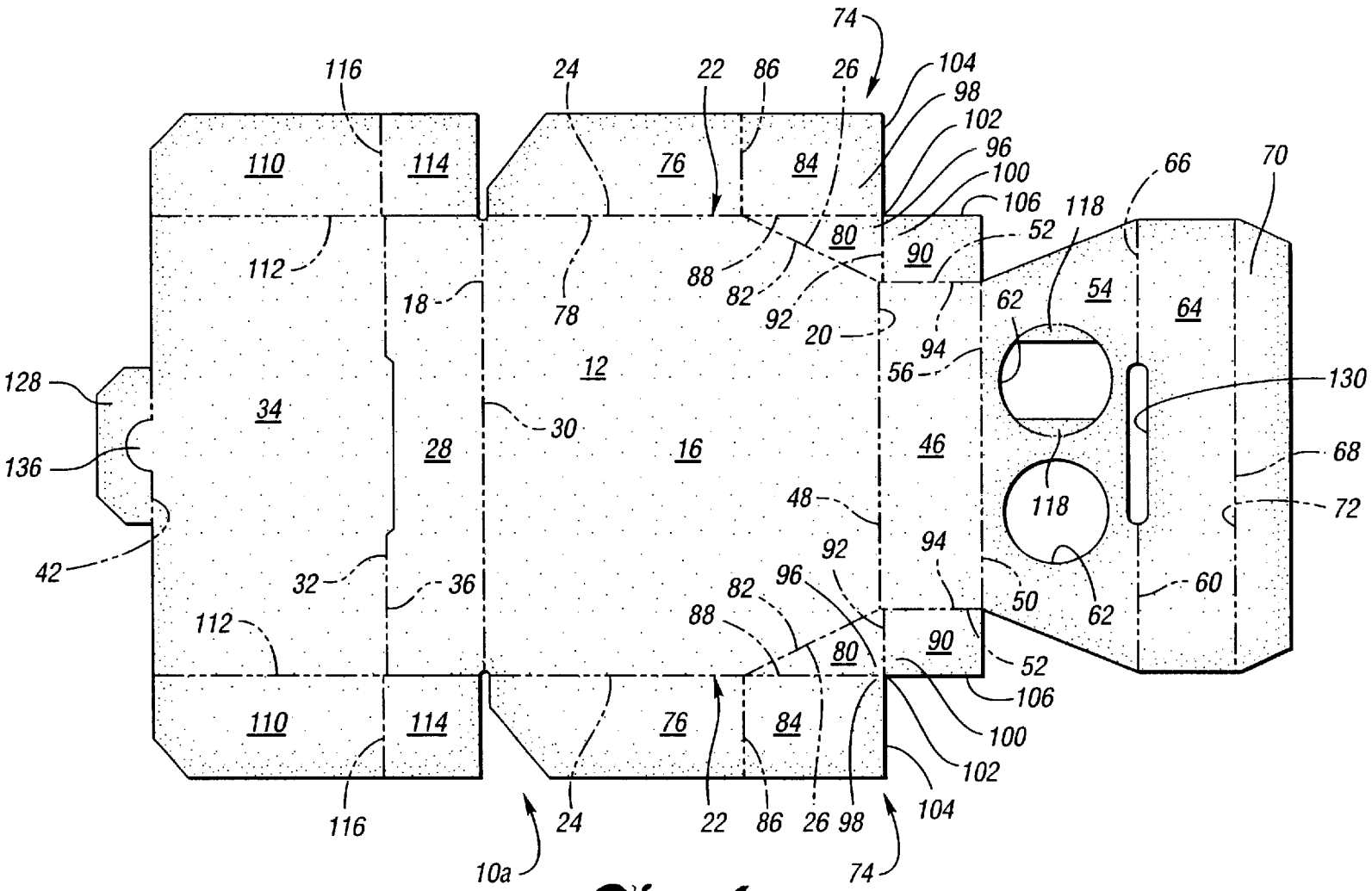
FIG. 4 is a view of a further embodiment having a dip tray panel having two round openings with one including diametrically opposite sizing tabs and also having a cover that covers only a food receptacle of the folded box.

In the embodiment of the food box 10*a* shown in FIG. 4, the dip tray panel 54 includes a pair of the openings 62 for respectively receiving a pair of dip sauce cups. Each of these openings 62 is round and one of the round openings includes a pair of diametrically opposite sizing tabs 118 that provide the capability of holding cups of different sizes. Furthermore, the embodiment of the food box 10*c* illustrated in FIG. 6 has both of its generally round openings 62 in the dip tray panel provided with a pair of diametrically opposite sizing tabs 118 so each opening has the capability of receiving dip sauce cups of different sizes.

With reference back to FIG. 1, the cover 34 includes a rearward portion 120 for covering the food receptacle 12 with the food box folded to its constructed position illustrated in FIG. 3, and the cover also includes a forward portion 122 that covers the dip tray panel 54. As previously mentioned, the front wall 46 and the dip tray panel 54 have a connection including the slit 58 that receives the cover tuck flap 40 to secure the cover in its closed position. Furthermore, the dip tray panel 54 includes at least one notch 124, and actually includes a pair of notches 124 respectively located at its opposite ends, so as to facilitate manual access to the forward cover portion 122 in its closed position to permit opening of the cover.

Figure 5:
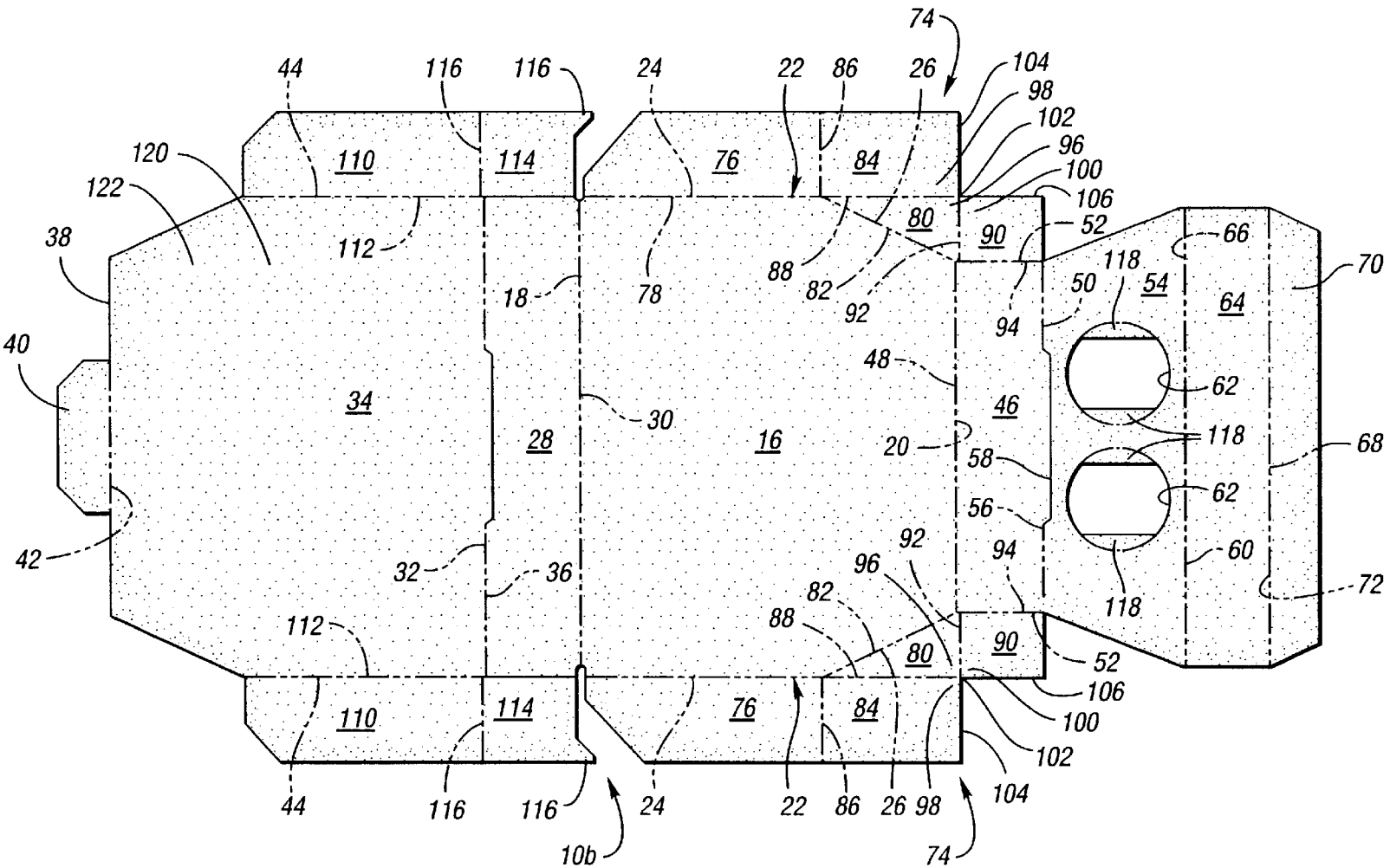
FIG. 5 is an embodiment that is similar to the previously described embodiments but has both of its dip tray panel openings provided with diametrically opposite sizing tabs as well as having cover side wall flaps with projections that extend toward each other after folding of the box.
Figure 6:
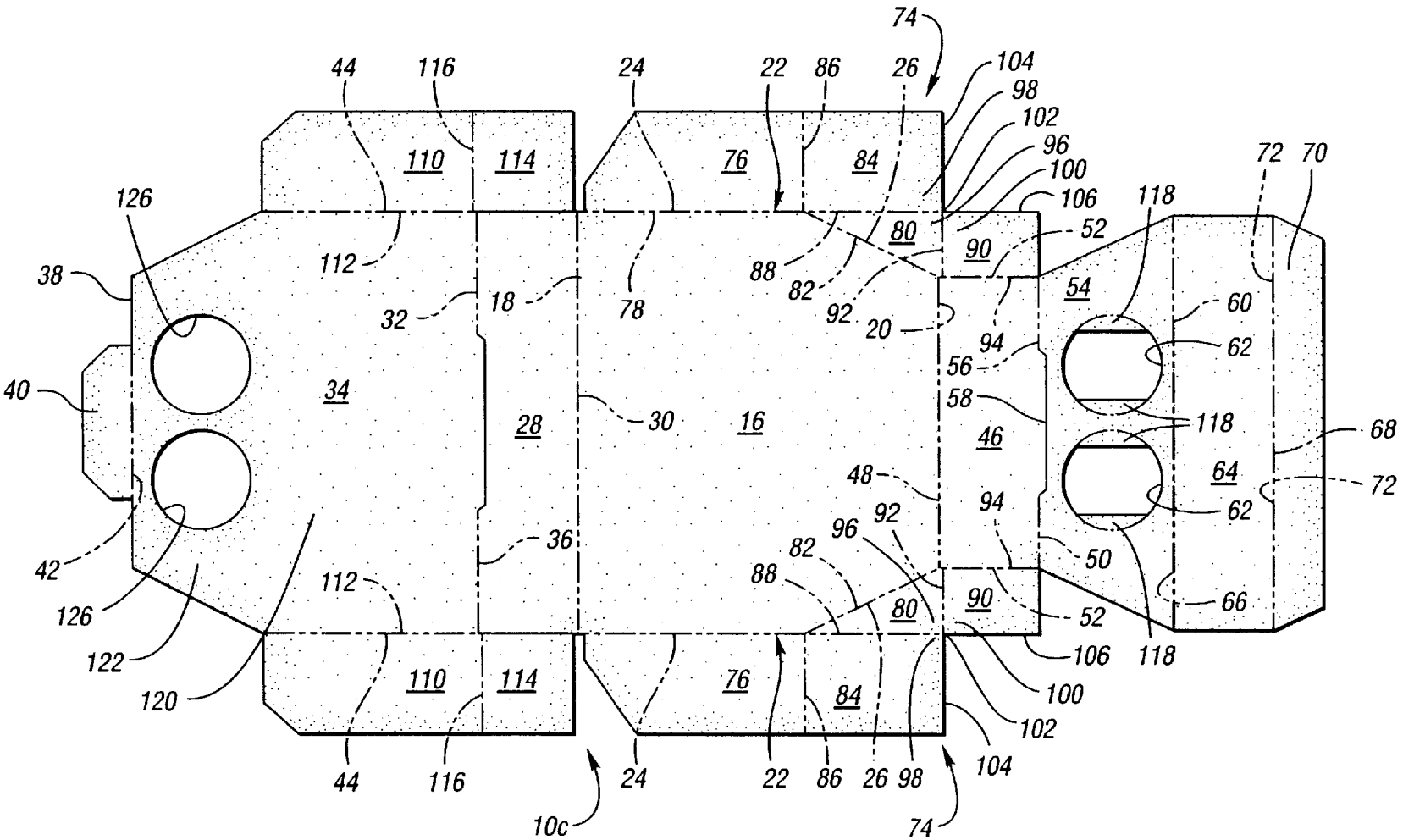
FIG. 6 is a view of a further embodiment of the food box which is similar to the previously described embodiments but has its cover provided with a forward portion having openings through which the dip sauce cups received by the dip tray panel can be viewed.

The food box embodiment 10 shown in FIG. 1 and the embodiment 10*b* shown in FIG. 5 have the forward cover portion 122 imperforate so as to totally cover the dip tray panel 54 in the closed cover position. In the food box embodiment 10*c* shown in FIG. 6, the forward cover portion 122 includes openings 126 through which the dip sauce cups supported by the dip tray panel 54 can be viewed to provide an indication of what type of sauce is part of the food package.

As illustrated in FIG. 4, the food box 10*a* has its cover 34 constructed with a generally rectangular shape so as to only cover the food receptacle portion 12 of the base 16 in the closed position of the cover. Thus, the dip sauce cups held by the dip tray panel 54 can then be viewed even with the cover closed like the embodiment of FIG. 6 where the cover openings 126 are provided to provide the viewing. Furthermore, the cover 34 includes a tuck flap 128 that is received by a slit 130 in the connection between the rear edge 60 of the dip tray panel 54 and the edge 66 of the support wall 64. The insertion of the tuck flap 128 into the slit 130 thus secures the cover in its closed position over the food receptacle 12 cooperatively defined by the base 16, the back wall 28 and the associated base side wall assemblies 74. Also, the cover includes a tab 136 that facilitates opening of the cover.

While the preferred embodiments for carrying out the invention have been described in detail, those familiar with the art to which this invention relates will recognize various alternative designs and embodiments for carrying out the invention as defined by the following claims.

What is claimed is:

1. A foldable cardboard food box comprising:

a base having a D shape including a straight back edge, a straight front edge of a smaller length than the back edge, a pair of side edges having a pair of rearward portions that extend from the back edge parallel to each other toward the front edge, and the pair of side edges also having a pair of forward portions that respectively extend from pair of rearward portions toward the front edge in a converging manner;

a back wall having a first edge connected to the back edge of the base and having a second edge extending in a spaced and parallel relationship to its first edge;

a cover having a first edge connected to the second edge of the back wall and having a second edge extending in a spaced and parallel relationship to its first edge and including a tuck flap, and the cover having an elongated shape including opposite ends;

a front wall having first edge connected to the front edge of the base and having a second edge extending in a spaced and parallel relationship to its first edge, and the front wall having an elongated shape including opposite ends;

a dip tray panel having a front edge connected to the second edge of the front wall and having a rear edge extending in a spaced and parallel relationship to its front edge but with a greater length, and the dip tray panel having at least one opening for receiving a dip sauce cup;

a support wall having a first edge connected to the rear edge of the dip tray panel and having a second edge including a tuck flap;

a pair of base side wall assemblies respectively connected to the pair of side edges of the base, each base side wall assembly including a rearward side wall connected to the rearward portion of one of the base side edges, a triangular connection panel connected to the forward portion of the associated base side edge, a first rectangular forward side wall connected to the rearward side wall and to the triangular connection panel, a second rectangular forward side wall connected to the triangular connection panel and the adjacent end of the front wall, and the triangular connection panel and the first and second rectangular forward side walls of each base side wall assembly each have right angle corners having a common junction with each other; and the back wall, the front wall, the dip tray panel, the support wall, and the pair of base side wall assemblies being foldable provide a food receptacle and to support the dip tray above the base with the first and second forward side walls of each base side wall assembly having engaged vertical edges providing a vertical junction with each other spaced rearwardly from the front wall to provide support of the dip tray panel, and the cover being foldable to close the food receptacle.

2. A foldable cardboard food box as in claim 1 further including a pair of cover side walls respectively connected to the opposite ends of the cover.

3. A foldable cardboard food box as in claim 2 further including a pair of cover back wall closure flaps respectively connected to the pair of cover side walls.

4. A foldable cardboard food box as in claim 3 wherein the pair of cover side wall flaps are square.

5. A foldable cardboard food box as in claim 3 wherein the pair of cover side wall flaps have projections that extend toward each other adjacent the rear edge of the base after folding of the food box.

6. A foldable cardboard food box as in claim 1 wherein the dip tray panel includes a pair of openings for respectively receiving a pair of dip sauce cups.

7. A foldable cardboard food box as in claim 6 wherein each of the pair of openings in the dip tray panel is round.

8. A foldable cardboard food box as in claim 6 wherein one of the pair of round openings in the dip tray panel includes a pair of diametrically opposite sizing tabs.

9. A foldable cardboard food box as in claim 6 wherein each of the pair of round openings in the dip tray panel includes a pair of diametrically opposite sizing tabs.

10. A foldable cardboard food box as in claim 1 wherein the cover includes a rearward portion that covers the food receptacle and a forward portion that covers the dip tray panel, and the front wall and dip tray panel having a connection including a slit that receives the cover tuck flap to secure the cover in a closed position.

11. A foldable cardboard food box as in claim 10 wherein the dip tray panel includes at least one notch that facilitates manual access to the forward portion of the cover for opening of the cover.

12. A foldable cardboard food box as in claim 10 wherein the dip tray panel includes a pair of notches that facilitate manual access to the forward portion of the cover for opening of the cover.

13. A foldable cardboard food box as in claim 10 wherein the forward portion of the cover is imperforate.

14. A foldable cardboard food box as in claim 10 wherein the forward portion of the cover includes openings through which dip sauce cups can be viewed.

15. A foldable cardboard food box as in claim 1 wherein the cover extends only over the food receptacle, and the dip tray panel and the support wall having a connection including a slit that receives the cover tuck flap to secure the cover in a closed position.

16. A foldable cardboard food box comprising:

a base having a D shape including a straight back edge, a straight front edge of a smaller length than the back edge, a pair of side edges having a pair of rearward portions that extend from the back edge parallel to each other toward the front edge, and the pair of side edges also having a pair of forward portions that respectively extend from pair of rearward portions toward the front edge in a converging manner;

a back wall having a first edge connected to the back edge of the base and having a second edge extending in a spaced and parallel relationship to its first edge;

a cover having a rear portion including a first edge connected to the second edge of the back wall and having a front portion including a second edge extending in a spaced and parallel relationship to the first edge of the cover and including a tuck flap, the rear cover portion having an elongated shape including opposite ends, a pair of cover side walls respectively connected to the opposite ends of the rear cover portion, and a pair of cover back wall closure flaps respectively connected to the pair of cover side walls;

a front wall having first edge connected to the front edge of the base and having a second edge extending in a spaced and parallel relationship to its first edge, and the front wall having an elongated shape including opposite ends;

a dip tray panel having a front edge connected to the second edge of the front wall and cooperating therewith to define a slit, and the dip tray panel having a rear edge extending in a spaced and parallel relationship to its front edge but with a greater length, and the dip tray panel having a pair of openings for receiving a dip sauce cup;

a support wall having a first edge connected to the rear edge of the dip tray panel and having a second edge including a tuck flap;

a pair of base side wall assemblies respectively connected to the pair of side edges of the base, each base side wall assembly including a rearward side wall connected to the rearward portion of one of the base side edges, a triangular connection panel connected to the forward portion of the associated base side edge, a first rectangular forward side wall connected to the rearward side wall and to the triangular connection panel, a second rectangular forward side wall connected to the triangular connection panel and the adjacent end of the front wall, and the triangular connection panel and the first and second rectangular forward side walls of each base side wall assembly each have right angle corners having a common junction with each other; and the back wall, the front wall, the dip tray panel, the support wall, and the pair of base side wall assemblies being foldable provide a food receptacle and to support the dip tray above the base with the first and second forward side walls of each base side wall assembly having engaged vertical edges providing a vertical junction with each other spaced rearwardly from the front wall to provide support of the dip tray panel, and the cover being foldable to close the food receptacle with the cover tuck flap received by the slit between the front edge of the dip tray and the second edge of front wall.

17. A foldable cardboard food box comprising:

a base having a D shape including a straight back edge, a straight front edge of a smaller length than the back edge, a pair of side edges having a pair of rearward portions that extend from the back edge parallel to each other toward the front edge, and the pair of side edges also having a pair of forward portions that respectively extend from pair of rearward portions toward the front edge in a converging manner;

a back wall having a first edge connected to the back edge of the base and having a second edge extending in a spaced and parallel relationship to its first edge;

a cover having a first edge connected to the second edge of the back wall and a second edge extending in a spaced and parallel relationship to its first edge and including a tuck flap, the cover having an elongated rectangular shape including opposite ends, a pair of cover side walls respectively connected to the opposite ends of the cover, and a pair of cover back wall closure flaps respectively connected to the pair of cover side walls;

a front wall having first edge connected to the front edge of the base and having a second edge extending in a spaced and parallel relationship to its first edge, and the front wall having an elongated shape including opposite ends;

a dip tray panel having a front edge connected to the second edge of the front wall and having a rear edge extending in a spaced and parallel relationship to its front edge but with a greater length, and the dip tray panel having a pair of openings for receiving a dip sauce cup;

a support wall having a first edge connected to the rear edge of the dip tray panel and cooperating therewith to define a slit, and the support wall having a second edge including a tuck flap;

a pair of base side wall assemblies respectively connected to the pair of side edges of the base, each base side wall assembly including a rearward side wall connected to the rearward portion of one of the base side edges, a triangular connection panel connected to the forward portion of the associated base side edge, a first rectangular forward side wall connected to the rearward side wall and to the triangular connection panel, a second rectangular forward side wall connected to the triangular connection panel and the adjacent end of the front wall, and the triangular connection panel and the first and second rectangular forward side walls of each base side wall assembly each have right angle corners having a common junction with each other; and the back wall, the front wall, the dip tray panel, the support wall, and the pair of base side wall assemblies being foldable provide a food receptacle and to support the dip tray above the base with the first and second forward side walls of each base side wall assembly having engaged vertical edges providing a vertical junction with each other spaced rearwardly from the front wall to provide support of the dip tray panel, and the cover being foldable to close the food receptacle with the cover tuck flap received by the slit defined by the support wall and the dip tray panel.

* * * * *